US005493745A

United States Patent [19]

Hauch

[11] Patent Number: 5,493,745

[45] Date of Patent: Feb. 27, 1996

[54] RECIRCULATION PUMP SYSTEM FOR A WASHING MACHINE

[75] Inventor: Dennis W. Hauch, Buchanan, Mich.

[73] Assignee: Whirlpool Corporation, Benton Harbor, Mich.

[21] Appl. No.: 365,842

[22] Filed: Dec. 29, 1994

[51] Int. Cl.[6] ..... D06F 39/08

[52] U.S. Cl. ..... 8/158; 68/18 D; 68/18 F; 68/208

[58] Field of Search ..... 8/158; 68/18 F, 68/18 D, 208

[56] References Cited

U.S. PATENT DOCUMENTS

| | | | |
|---|---|---|---|
| 3,084,530 | 4/1963 | Gabriel | 68/12.12 |
| 3,091,107 | 5/1963 | Rhodes | 68/4 |
| 3,170,314 | 2/1965 | Worst | 8/158 X |
| 3,266,274 | 8/1966 | Schwing | 68/208 X |
| 3,312,234 | 4/1967 | Morey | 68/208 X |
| 3,681,947 | 8/1972 | Cowan | 68/18 F |
| 3,707,856 | 1/1973 | Niewyk et al. | 68/208 X |
| 3,727,435 | 4/1973 | Menk | 68/18 F |
| 3,891,548 | 6/1975 | Marcussen | 68/18 F X |
| 4,467,627 | 8/1984 | Platt et al. | 68/208 X |

*Primary Examiner*—Philip R. Coe
*Attorney, Agent, or Firm*—Hill, Steadman & Simpson

[57] ABSTRACT

A washing machine recirculation and draining system including two bottom drains in a wash tub, the drains connected by a tubing manifold having a reversible pump. A two-way valve opens one drain and closes a drain line during recirculation; the pump rotating in a first direction to pump wash water through a recirculation line. For draining, a second two-way valve opens the second drain and the first two-way valve closes the first drain and opens the drain line; the pump rotates in a second direction to drain the tub out through the drain line.

15 Claims, 2 Drawing Sheets

RECIRCULATION PUMP SYSTEM FOR A WASHING MACHINE

BACKGROUND OF INVENTION

The present invention relates to washing machine draining and recirculation systems. Particularly, the invention relates to a vertical washing machine having filtering apparatus for lint removal and particularly to a combined self-cleaning filter and drain manifold for an automatic washing machine having a reversible hydraulic circuit for circulating laundry liquid first in one direction during a washing operation and then in an opposite direction during an extracting and draining operation.

A combination drain manifold and self-cleaning filter arrangement for a washing machine is disclosed in U.S. Pat. No. 3,681,947. In that patent, a combined drain manifold and lint filter assembly is disclosed connected directly to a drain port formed in a tub of an automatic washing machine. The lowermost wall of the drain manifold is formed by a flexible wall of a self-cleaning diaphragm filter so that the static water head pressure from the tub acts on the filter diaphragm to keep it closed without a backup plate or springs. Fluid entering the drain manifold is directed downwardly, across a side of the diaphragm opposite the filtering chamber then upwardly to an exit port, thereby flushing the drain manifold of sand and other small particles while trapping larger items such as buttons.

SUMMARY OF THE INVENTION

It is an object of the present invention to provide a simple yet effective washing machine hydraulic system which does not require electrically operated valves or additional pumps. It is an object of the present invention to provide a recirculation and hydraulic system without requiring a complex arrangement of the inlet port for recirculating wash water. It is an object of the invention to provide a recirculation system which requires only a reversing pump. It is an object of the invention to provide a self-cleaning filtering system incorporated into a single recirculation and drain system. It is an object to provide a sediment trap in a recirculation and drain system which can be effectively flushed during the drain cycle.

The objects of the invention are achieved in that a wash water recirculation and drain system is provided wherein a wash tub comprises two outlets at a bottom thereof, the outlets closeable by pressure activated valves such as flapper or ball valves. The outlets are connected to a center manifold having a reversible pump and a filter. A recirculation line and a drain line are each connected on opposite ends of the manifold. The valves are dual acting valves which alternately open and close one outlet and one of the drain line and recirculation line respectively. During recirculation, a first tub outlet is opened and the drain line is closed by action of a first valve. The pump draws water in a first direction through the filter and forces the water through the open recirculation line into the tub. A second valve closes a second tub outlet. During draining, the first tub outlet is closed while the drain is opened and the pump reverses and draws water through the second tub outlet, open by action of the second valve, in a reverse direction and forces the water through the filter to flush the filter, and through the now open drain line, open by action of the first valve. A low point sediment trap is located between the first tub outlet and the filter. The low point sediment trap can be fashioned reasonably shallow to allow flushing of the trap during the drain cycle.

As a simpler arrangement, the recirculation line, and the second valve are deleted and the pump is connected by a tube directly into the second tub outlet. The second tub outlet also serves the function of a recirculation line during the recirculation cycle.

In another modification, the filter is relocated into the recirculation line and can be a manually cleanable filter.

DETAILED DESCRIPTION OF THE PREFERRED EMBODIMENTS

Figure 1:
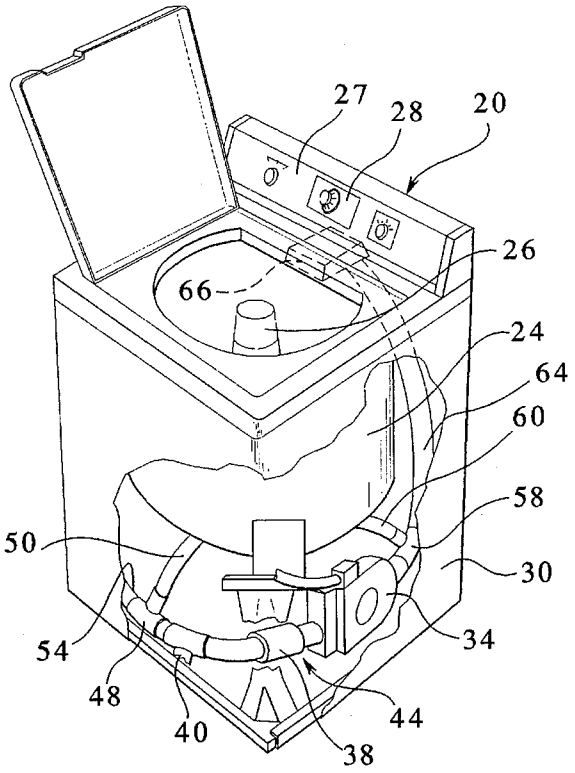
FIG. 1 is a perspective view of a washing machine with portions removed for clarity.

FIG. 1 illustrates a washing machine 20 having a vertical axis tub 24 within which a vertical axis basket 25 and agitator 26 is operable. A control panel 27 is provided having controls 28 for operation of the washing machine. Inside the cabinet 30 is located a reversible pump 34, an in line filter 38, a sump 40, all connected together in series forming a manifold 44. At one end of the manifold 44 is a first two-way valve 48 connected to a first tub drain 50 and an outlet drain line 54 for draining the tub. At an opposite end of the manifold 44 is a second two-way valve 58 connected a second outlet 60 of the tub and to a recirculation line 64 which extends upward to a distribution head or nozzle 66 for spraying water into the tub 24.

Figure 2:
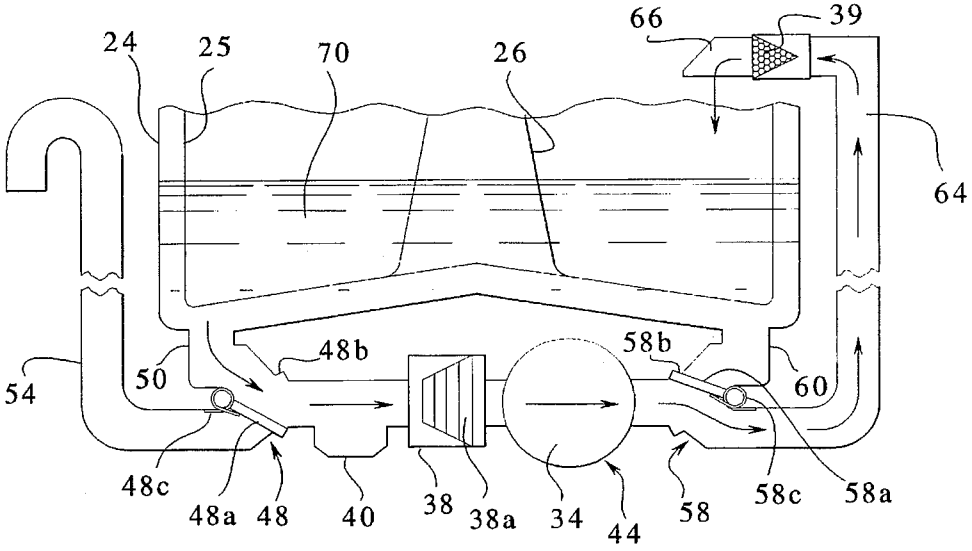
FIG. 2 is a schematic view of a recirculation/drain system of the present invention, in a recirculation mode of operation.
Figure 3:
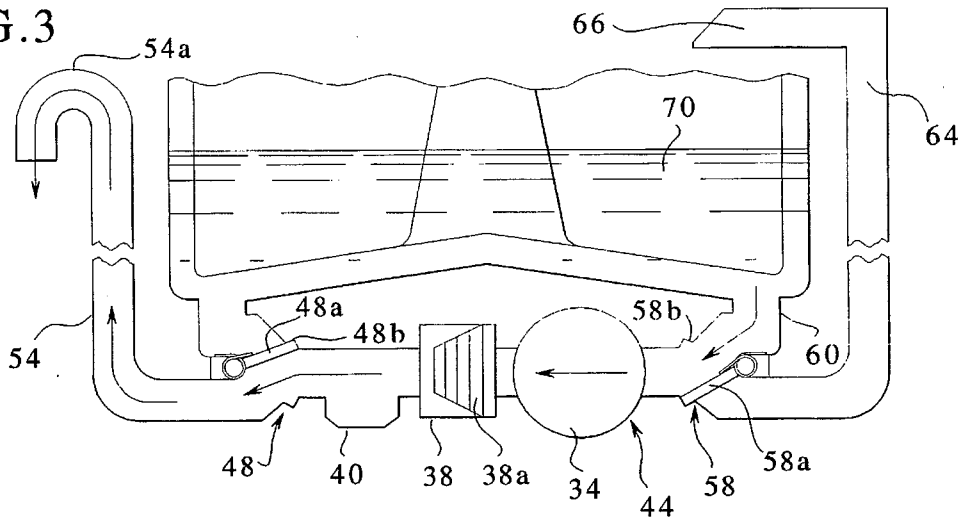
FIG. 3 is a schematic view according to FIG. 2 in a drain mode of operation.

FIGS. 2 and 3 show in schematic fashion the operating system for recirculation and alternately drainage of tub water 70. FIG. 2 shows the system in a recirculation mode of operation. The two-way valves 48, 58 are shown comprising flappers 48*a*, 58*a* respectively. The flappers are normally spring biased against valve seats 48*b*, 58*b* respectively, by, for example, coil springs 48*c*, 58*c* respectively. During the recycle mode the reversible pump 34 draws water 70 from the tub 24. Suction from the pump 34 pulls open the flapper 48*a* to release water from the first outlet 50. The water is drawn through the filter 38 and particularly through a filter element 38*a* where lint and debris is collected in addition to, or in lieu of, the filter element 38, a manually cleaned filter 39 can be installed in the recycle line, such as in the head 66. Additionally, sand and fine particles are collected in a sediment trap or sump 40 upstream of the filter 38. On a downstream side of the pump 34 pressure elevation keeps flapper 58*a* sealed against the seat 58*b* to prevent water entering the second outlet 60. Water is pumped through the recycle line 64 and out to the recycle distribution head 66 for reentry into the tub 24.

FIG. 3 illustrates the drain cycle of the washing apparatus wherein the pump 34 is reversed. Reversible pumps are described, for example, in U.S. Pat. Nos. 3,084,530; 3,312,234; 3,091,107; and 3,681,947; incorporated by reference. The flapper 58*a* is drawn away from the seat 58*b* by suction pressure of the pump 34; water is drained from the second outlet 60 through the pump 34 which pumps the water in a reverse direction through the filter element 38*a*, flushing the filter element of lint and other debris. The sump 40 can be of a relatively shallow depth such as the water passing thereover also flushes sediment from the sump 40. The flapper 48*a* is held tightly against the seat 48*b* by the spring force and the elevated pressure of the water downstream of the filter 38 and the sump 40. Water enters the drain line 54 and exits at the goose neck 54*a* into a wash basin, drain or other disposal means.

The invention thus provides a two-way manifold including reversible pump, filter and two two-way valves to alternately recycle or drain water from a wash tub.

Figure 4:
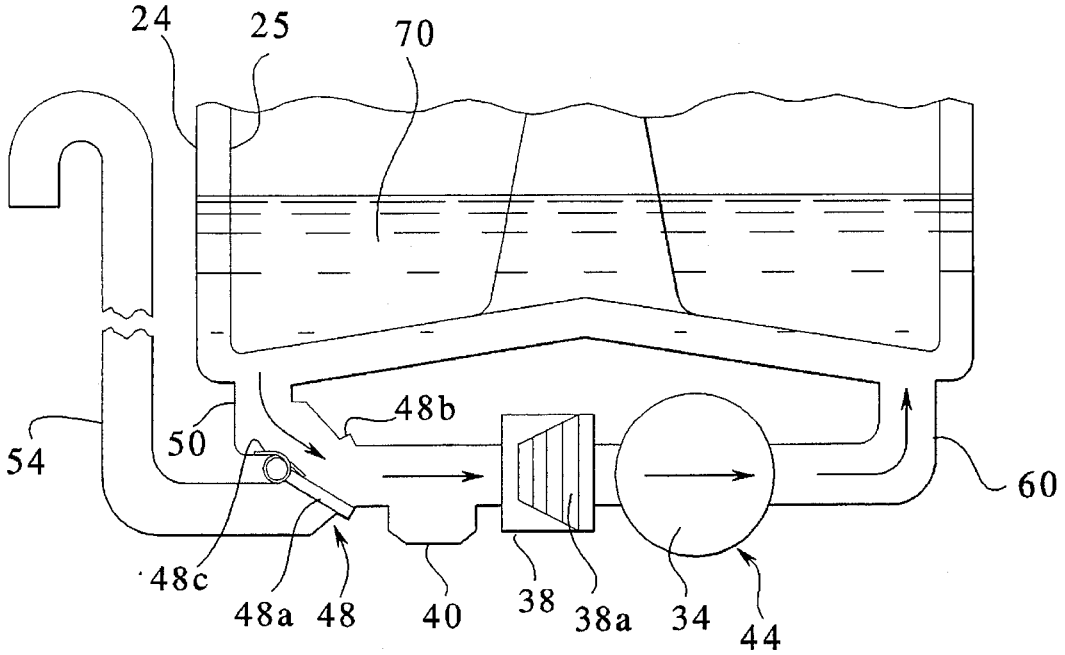
FIG. 4 is a schematic view of alternate embodiment of the present invention in a recirculation mode of operation.
Figure 5:
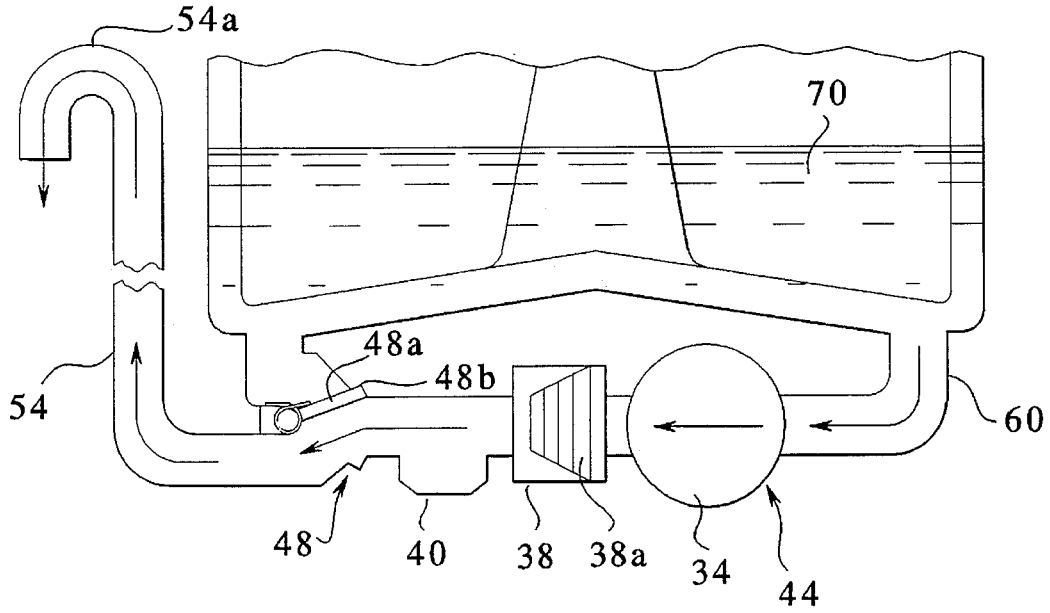
FIG. 5 is a schematic view of the embodiment of FIG. 4 in a drain mode of operation.

FIG. 4 illustrates an alternate embodiment which is even more simplified. According to FIG. 4, the second flapper valve 58 is deleted and the recycle line 64 is deleted. Thus, when recycling wash water from the tub 24, the pump 34 pumps the water in a reverse direction through the second outlet 60 and up into the tub. As shown in FIG. 5, in a drain mode of operation, there is no need to open a flapper valve in the second outlet 60 and water is directly pumped from the second outlet 60 and pressurized by the pump 34 to pass through the filter 38 and out through the drain line 54.

Although the present invention has been described with reference to a specific embodiment, those of skill in the art will recognize that changes may be made thereto without departing from the scope and spirit of the invention as set forth in the appended claims.

I claim as my invention:

1. A washing machine, comprising:

a wash tub having first and second outlets at a bottom thereof;

a reversible water pump;

a manifold connecting said first and second outlets and having said reversible water pump in-line in said manifold;

a drain line connected at a first end of said manifold and a recirculation line connected at a second end of said manifold, said recirculation line arranged to deliver water to said tub, said drain line arranged to dispose water from said tub, said pump in a first direction of operation, during a recirculation mode of operation, receiving water from said first outlet and pumping water through said recirculation line into said tub, and in a second direction of rotation taking suction from said second outlet and pumping water through said drain line; and a first two-way valve arranged at said first end of said manifold and operable to alternately open said first outlet, and close said first outlet while opening said drain line.

2. The washing machine as claimed in claim 1 further comprising a lint filter arranged in said manifold upstream of said pump in said recirculation mode of operation.

3. The washing machine as claimed in claim 2 further comprising a sediment sump arranged upstream of said lint filter in said manifold in said recirculation mode of operation.

4. The system as claimed in claim 2 further comprising a sediment sump arranged upstream of said manifold in a recirculation mode of operation.

5. The washing machine as claimed in claim 1 wherein said recirculation line is connected between said second outlet and said reversible water pump.

6. The washing machine as claimed in claim 5 further comprising a lint filter arranged in said manifold upstream of said pump in said recirculation mode of operation.

7. The system as claimed in claim 5 further comprising a lint filter arranged in said manifold upstream of said pump in said recirculation mode of operation.

8. The washing machine as claimed in claim 1 further comprising a second two-way valve arranged to alternately close said second outlet while opening said recirculation line and open said second outlet.

9. The washing machine as claimed in claim 8 further comprising a lint filter located in said recirculation line.

10. A recirculation/draining system for a washing machine comprising:

a wash tub having first and second outlets at a bottom thereof;

a manifold connecting said first and second outlets and having a reversible pump in-line in said manifold;

a drain line connected at a first end of said manifold and a recirculation line connected at a second end of said manifold, said recirculation line arranged to deliver water to said tub, said drain line arranged to dispose water from said tub;

a first two-way valve arranged at said first end of said manifold and operable to alternately open said first outlet and close said first outlet while opening said drain line; and a second two-way valve arranged to alternately close said second outlet while opening said recycle line and open said second outlet.

11. A method of operating a washing machine comprising the steps of:

providing first and second outlets in a bottom of a wash tub of said washing machine;

providing a manifold line connecting said first outlet to said second outlet and extending from said first and second outlets into a drain line and a recirculation line respectively;

providing a first two-way valve for alternately closing said first outlet and closing said drain line respectively;

providing a reversible pump within said manifold line;

operating said reversible pump in a first direction to create a pressure differential in said manifold line to open said first outlet by opening said first two-way valve;

recirculating wash water from said first outlet through said pump through said recirculation line into said tub;

reversing said direction of operation of said pump to a second direction to create a pressure differential in said manifold, closing said first outlet and opening said drain line by moving said first two-way valve, moving water from said second outlet through said pump and out through said drain line.

12. The method according to claim 11, comprising the further steps of:

providing a second two-way valve between said manifold, said second outlet and said recirculation line; and opening said second two-way valve and said second outlet during draining cycle and closing said second two-way valve and said second outlet during recirculation while opening said recirculation line.

13. The method according to claim 12 comprising the further step of:

providing a filter on an upstream side of said pump in a recirculation flow direction and removing lint and other debris against said filter during the recirculating step.

14. The method according to claim 13 comprising the further step of:

providing a sediment sump upstream of said filter and removing sediment from said wash water during said recirculating step.

15. The method of claim 13 wherein said step of providing a filter is further defined in that when said pump is pumping water out from said drain line, passing said water through said filter in a reverse direction to flush said filter.

* * * * *